US009930919B1

(12) United States Patent
Branker et al.

(10) Patent No.: US 9,930,919 B1
(45) Date of Patent: Apr. 3, 2018

(54) HAIR EXTENSION INTEGRATION SYSTEM

(71) Applicants: Gladys Branker, Lincoln, NE (US); Rachel Branker, Bronx, NY (US)

(72) Inventors: Gladys Branker, Lincoln, NE (US); Rachel Branker, Bronx, NY (US)

( * ) Notice: Subject to any disclaimer, the term of this patent is extended or adjusted under 35 U.S.C. 154(b) by 213 days.

(21) Appl. No.: 14/866,939

(22) Filed: Sep. 26, 2015

(51) Int. Cl.
*A45D 8/24* (2006.01)
*A45D 8/36* (2006.01)
*A41G 5/00* (2006.01)

(52) U.S. Cl.
CPC ..... *A41G 5/0073* (2013.01); *A45D 8/24* (2013.01); *A45D 8/36* (2013.01)

(58) Field of Classification Search
CPC ..... A41G 5/00; A41G 5/0026; A41G 5/0073; A41G 5/0093; A45D 8/24; A45D 8/26; A45D 8/36
USPC ..... 132/276, 53
See application file for complete search history.

(56) References Cited

U.S. PATENT DOCUMENTS 3,460,546 A * 8/1969 Abbott ..... A41G 5/0093 132/53
4,406,296 A * 9/1983 Wexler ..... A41G 5/0093 132/148
5,365,954 A * 11/1994 Rude ..... A45D 8/00 132/273
5,477,870 A * 12/1995 Menaged ..... A45D 8/34 132/278
5,501,239 A * 3/1996 Walker ..... A41G 5/0073 132/201
5,647,384 A * 7/1997 Haber ..... A41G 5/00 132/105
5,682,908 A * 11/1997 Chou ..... A45D 8/12 132/276
5,806,535 A * 9/1998 Becker ..... A41G 3/0016 132/53
6,257,251 B1 * 7/2001 Burleson ..... A45D 8/24 132/279
6,394,102 B1 * 5/2002 Vogel ..... A45D 8/24 132/273
6,688,316 B1 * 2/2004 Klug ..... A45D 8/00 132/275
6,766,805 B1 * 7/2004 Cupp ..... A41G 5/0073 132/273
7,168,432 B1 * 1/2007 Brumfield ..... A41G 5/0073 132/201
D668,818 S * 10/2012 Jones ..... D28/42
9,179,721 B2 * 11/2015 Hines ..... A41G 3/0033
(Continued)

*Primary Examiner* — Todd E Manahan
*Assistant Examiner* — Jennifer Gill
(74) *Attorney, Agent, or Firm* — Werschulz Patent Law, LLC

(57) ABSTRACT

A hair extension integration system having a plurality of hairpieces, a headband and a plurality of barrettes, the system selectively integrating with the user's natural hair without the need of any other attachment devices. Hook and loop fastener material attaches the hairpieces to the headband and barrettes. The hook and loop fastener material faces away from natural hair and skin of the user, protecting the hair from snags and friction. The hair extensions are not limited to one size or color. The hook material is preferably on the hairpieces and the loop material is preferably on the headband and barrettes. The system has a kit comprising the hairpieces, the headband and at least one barrette.

2 Claims, 6 Drawing Sheets

(56) References Cited

U.S. PATENT DOCUMENTS

| | | | | |
|---|---|---|---|---|
| 2002/0066462 | A1* | 6/2002 | Denebeim | A45D 8/00 132/275 |
| 2003/0172948 | A1* | 9/2003 | Gabriele-Baumann | A45D 8/14 132/275 |
| 2004/0055617 | A1* | 3/2004 | Brantley | A45D 8/24 132/278 |
| 2004/0216760 | A1* | 11/2004 | Lane | A41G 5/0073 132/277 |
| 2007/0199571 | A1 | 8/2007 | McCulloch | |
| 2008/0178902 | A1 | 7/2008 | Moeszinger | |
| 2009/0120451 | A1 | 5/2009 | Kenna | |
| 2010/0212685 | A1* | 8/2010 | Garza | A45D 8/36 132/275 |
| 2011/0297179 | A1* | 12/2011 | Tu | A45D 8/16 132/278 |
| 2012/0125356 | A1* | 5/2012 | Alex | A41G 5/008 132/201 |
| 2014/0290682 | A1* | 10/2014 | Wendschuh | A45D 8/34 132/200 |
| 2015/0013710 | A1 | 1/2015 | Buzaglo et al. | |
| 2015/0034112 | A1 | 2/2015 | Queen | |

* cited by examiner

HAIR EXTENSION INTEGRATION SYSTEM

TECHNICAL FIELD

The present disclosure relates generally to a hair extension system. More particularly, the present disclosure relates to a hair extension integration system and kit with a plurality of hairpieces and interchangeable members that integrate with natural hair.

BACKGROUND

People have used hairpieces to enhance the appearance of their natural hair since Roman times. Hairpieces are worn to add volume or length to the natural hair or to cover thinning or bald spots. Hairpieces can be made from human hair or synthetic polymers.

Some hairpieces are attached permanently to the natural hair. Hair weaves are a technique in which base of a hairpiece is woven into whatever natural hair the wearer retains. While this (it is often promised) results in a less detectable hairpiece, the wearer can experience discomfort, and sometimes hair loss from frequently retightening of the weave as one's own hair grows. After about six months a person can begin to lose hair permanently along the weave area, creating a larger problem that the weave was trying to ameliorate.

In addition to hair weaves, wefts of hair, called hair extensions, are often attached to the natural hair to increase the length and volume. Hair extensions cannot be used in bald spots. In the simplest attachment technique, the hair wefts have small clips that snap into place onto a small section of natural hair. These hair extensions are not permanent and must be removed daily. Others use metal micro loops that remain in the hair for months.

Others glue the wefts onto the natural hair with a special glue. These last weeks, but must be removed carefully or permanent damage to the natural hair will result.

Many other attachment variations are available such as skullcaps, lace fronts, strings, ribbons, tracking and netting, to name a few, each with advantages and disadvantages to the wearer.

While these systems may be suitable for the particular purpose employed, or for general use, they would not be as suitable for the purposes of the present disclosure as disclosed hereafter.

In the present disclosure, where a document, act or item of knowledge is referred to or discussed, this reference or discussion is not an admission that the document, act or item of knowledge or any combination thereof was at the priority date, publicly available, known to the public, part of common general knowledge or otherwise constitutes prior art under the applicable statutory provisions; or is known to be relevant to an attempt to solve any problem with which the present disclosure is concerned.

While certain aspects of conventional technologies have been discussed to facilitate the present disclosure, no technical aspects are disclaimed and it is contemplated that the claims may encompass one or more of the conventional technical aspects discussed herein.

BRIEF SUMMARY

An aspect of an example embodiment in the present disclosure is to provide a hair extension integration system that adds volume length to a user's natural hair without the need of a skullcap, strings or ribbons for attachment purposes. Accordingly, an aspect of an example embodiment in the present disclosure provides a system of a plurality of hairpieces, a headband and a plurality of barrettes that selectively integrate with the user's natural hair without the need of any other attachment devices.

Another aspect of an example embodiment in the present disclosure is to provide a hair extension integration system that protects the natural hair from snags and friction with hairpieces are disposed on a user's head. Accordingly, the present disclosure provides hook and loop fastener material for attaching the hairpieces that faces away from natural hair and skin of the user, protecting the hair from snags and friction.

A further aspect of an example embodiment in the present disclosure is to provide a hair extension integration system that allows a user to arrange a user's hair with a plurality of hairpieces in a variety of styles. Accordingly, the present disclosure provides a hair extension integration kit that includes a plurality of hairpieces, a hair band and at least one barrette, allowing the user to arrange the user's hair in a variety of styles.

The present disclosure describes a hair extension integration system having a plurality of hairpieces, a headband and a plurality of barrettes that selectively integrate with the user's natural hair without the need of any other attachment devices. Hook and loop fastener material attaches the hairpieces to the headband and barrettes. The hook and loop fastener material faces away from natural hair and skin of the user, protecting the hair from snags and friction. The hair extensions are not limited to one size or color. The hook material is preferably on the hairpieces and the loop material is preferably on the headband and barrettes. The system has a kit comprising the hairpieces, the headband and at least one barrette.

The present disclosure addresses at least one of the foregoing disadvantages. However, it is contemplated that the present disclosure may prove useful in addressing other problems and deficiencies in a number of technical areas. Therefore, the claims should not necessarily be construed as limited to addressing any of the particular problems or deficiencies discussed hereinabove. To the accomplishment of the above, this disclosure may be embodied in the form illustrated in the accompanying drawings. Attention is called to the fact, however, that the drawings are illustrative only. Variations are contemplated as being part of the disclosure.

BRIEF DESCRIPTION OF THE DRAWINGS

In the drawings, like elements are depicted by like reference numerals. The drawings are briefly described as follows.

The present disclosure now will be described more fully hereinafter with reference to the accompanying drawings, which show various example embodiments. However, the present disclosure may be embodied in many different forms and should not be construed as limited to the example embodiments set forth herein. Rather, these example embodiments are provided so that the present disclosure is thorough, complete and fully conveys the scope of the present disclosure to those skilled in the art.

DETAILED DESCRIPTION OF THE PREFERRED EMBODIMENTS

Figure 1:
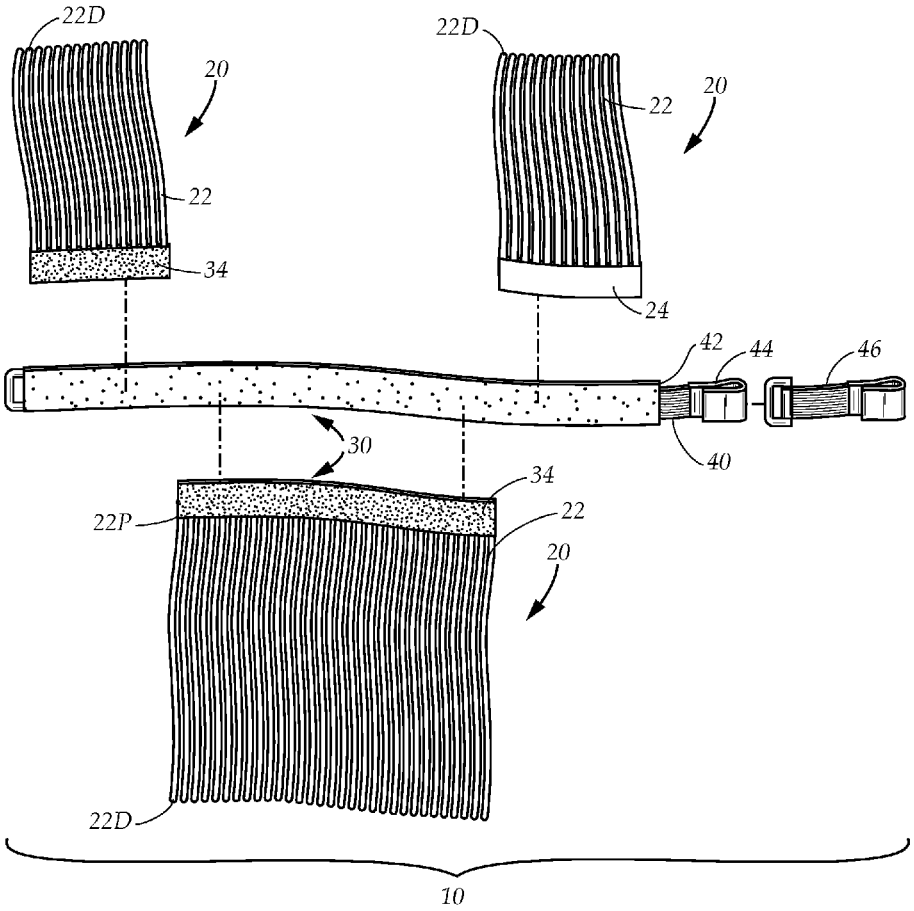
FIG. 1 is a perspective view of an example embodiment of a hair extension system, with a headband and a plurality of hair extensions.

FIG. 1 illustrates components of an example embodiment of a hair extension integration system 10 that selectively adds volume and length to natural hair. The system comprises a plurality of hairpieces 20 and a headband 40. The system allows a user to easily position and arrange hairpieces 20 in a temporary manner, and either remove or rearrange the hairpieces 20 for a different appearance.

Each hairpiece 20 has a multiplicity of hair wefts 22, each weft having a distal end 22D and a proximal end 22P. The distal ends 22D of the wefts 22 are disposed between a hook and loop fastener fabric 30 on a first side and a cover 24 on a second side. In a further example embodiment, the hook and loop fastener fabric is a hook fabric 34 covered with a plurality of hooks of the hook and loop fastener fabric. In a further example embodiment, the cover 24 is a soft protective lace.

It is understood that the hairpieces 20 are not restricted by color or length of the hair wefts, and color and length of the hair wefts are not a limitation in the current disclosure.

In the present disclosure, the term "natural hair" refers to hair growing on a head of a user and can include hair that is permanently bonded to hair growing on a head of a user. The term natural hair as used in the disclosure does not refer to any human hair strands used to construct the hairpieces 20. It is understood that the weft strands in the hairpieces 20 may be artificial hair strands or human hair strands and the term "human hair" refers to strands in the hairpieces and "natural hair" refers to hair growing on the head of the user.

The headband 40 has a hook and loop fastener fabric 30 on a first side and a smooth surface 42 on a second side. The hook and loop fastener fabric 30 of the hairpieces 20 attach to the hook and loop fastener fabric 30 of the headband 40. All hairpieces 20 in the system that have hook and loop fastener fabric 30 face away from the natural hair and skin of the user. In a further example embodiment, the fabric 30 on the headband 40 comprises a loop fabric 42 covered with a plurality of loops of the hook and loop fastener. In this example embodiment of the system 10, all components, such as the headband 40, to which the hair pieces attach to that have hook and loop fastener fabric 30 covered to protect the natural hair and skin of the user.

In one further example embodiment, the headband 40 and the hook and loop fastener fabric are constructed from soft, stretchable fabric, thereby minimizing any damage to the natural hair and skin of the user from friction when the system is applied to the user's head.

In one example embodiment, the headband 40 is linear, having a pair of ends 40 and has a fastener 44 configured for selectively fastening the headband 40 around a user's head. The headband 40 optionally has an extender segment 46, configured for increasing the circumference of the headband 40 by attaching to the fastener 44. In another example embodiment, which is not shown in the drawings, the headband 40 is a continuous circular loop, not requiring a fastener or the extender segment.

The first hairpiece 20 couples to the headband 40, the distal weft ends 22D facing in a first direction. A second hairpiece 20 couples to the headband 40 next to the first hairpiece on the headband. The distal weft ends 22D of the second hairpiece 20 face in a second direction, opposite the distal weft ends 22D of the first hairpiece. A third hairpiece 20 near the second end of the linear headband is possible in the system when used in conjunction with the linear headband 40, the distal weft ends 22D of the third hairpiece facing in the direction of one hairpiece on the first end of the linear headband 30 and in the opposite direction of the other hairpiece. In one example embodiment of the system, when the hairpieces 20 are placed on the headband 40, the hook and loop fastener fabric 30 of the headband 40 is substantially covered by the hook and loop fastener fabric of the hairpieces 20, protecting the natural hair and skin of the user from snagging and irritation.

When the headband 40 is a continuous circular loop, two hairpieces may be used, the distal weft ends 22D facing in opposite directions.

Figure 2:
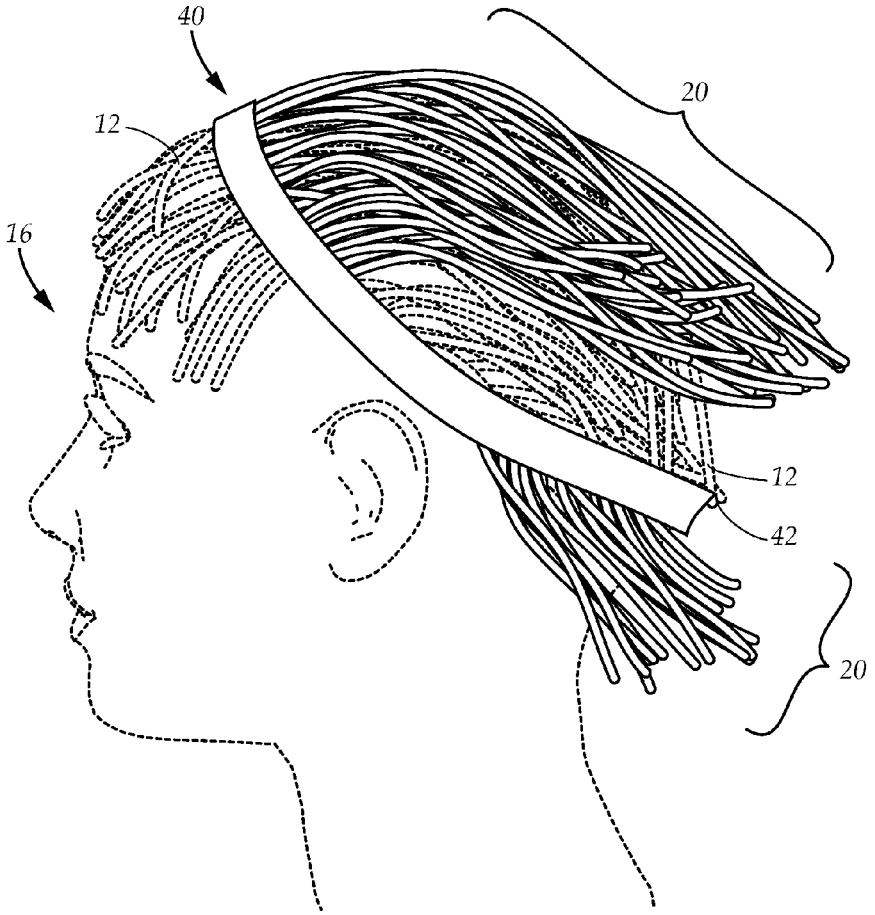
FIG. 2 is a perspective view of an example embodiment of the hair extension system with the headband and hair extensions integrating with natural hair, shown in outline.

FIG. 2 shows how the hairpieces 20 layer with the natural hair 12 when placed in such a manner as described hereinabove.

The headband 40 is placed on the user's head 16. The first hairpiece 20 layers over the natural hair 12, and the second hair piece 20 and in one example embodiment, the third hair piece layer under the natural hair 12, providing volume to the appearance as well as length. The natural hair 12 is surrounded and sandwiched in between when the headband 40 is so placed. Natural hair 12 can also be combed forward from under the headband 40 to form bangs. Because one of the hairpieces 20 is positioned in the opposite direction as the other, the hairpiece under the natural hair lies in a more natural manner, against a neck of the user 16 and the hairpiece 20 over the natural hair 12 adds volume more naturally as it extends over the natural hair 12. By surrounding the natural hair 12, the hairpiece 20 integrates with the natural hair, giving a more natural appearance. The hairpieces 20 along with the natural hair 12 can be gathered to form a ponytail.

Figure 3A:
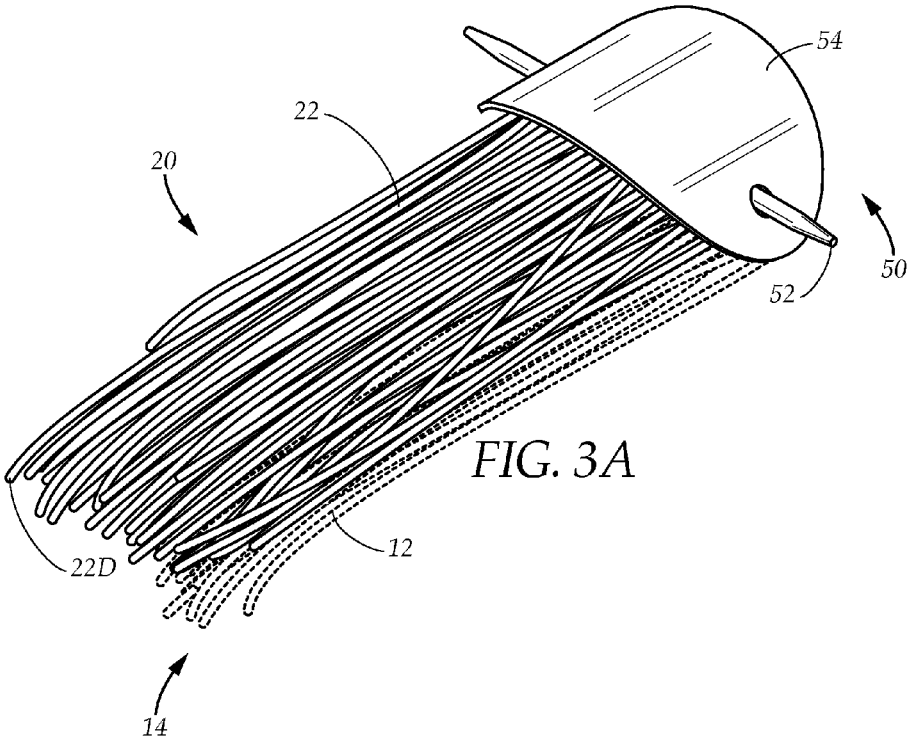
FIG. 3A is a perspective view of the exterior of another example of the hair extension system with a barrette and a hair extension integrating with natural hair, shown in outline.
Figure 3B:
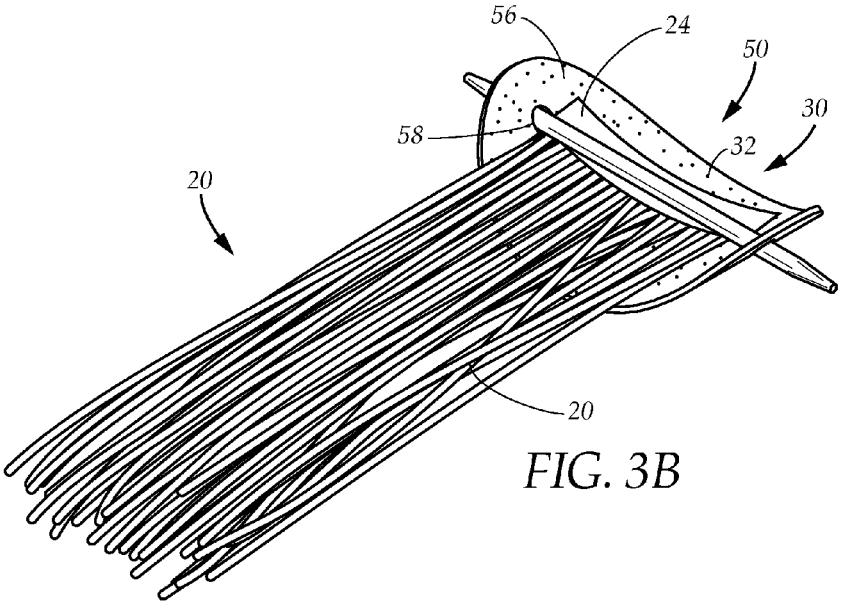
FIG. 3B, similar to FIG. 3A, is a perspective view of an interior of another example of the hair extension system with the barrette and the hair extension.

FIG. 3A and FIG. 3B show further components of the hair extension integration system. The system further comprises a barrette; the barrette may be of various configurations. The barrette 50 in FIGS. 3A and 3B is a "pin and cuff" style of barrette. In this disclosure, "pin and cuff barrette" has two parts, a "cuff" 54 part that is semi-circular, having a pair of holes 58 opposite each other, substantially at the ends of the cuff 54 near the diameter of the semi-circle. A "pin" 52 inserts through the holes 58, defining an internal semi-circular volume for hair or hairpieces.

The cuff 54 has an interior surface 56 shown in FIG. 3B, which is covered by a hook and loop fastener fabric 30. In one example embodiment, the hook and loop fastener fabric 30 is loop fastener 32. The hairpiece 20, having the hook and loop fastener fabric, as described hereinabove, attaches to the interior surface 56. The distal ends 22D of the wefts 22 face opposite the barrette 50. The cover 24 is opposite the interior surface 56.

As shown in FIG. 3A, natural hair 12 is gathered and placed next to the cover 24 away from the hook and loop fastener fabric 30, the cover protecting the natural hair 12 from snagging and breaking from friction. The pin 52 is placed through the holes 58, thereby securing the natural hair 12 next to the hairpiece 20. The natural hair 12 and the hairpiece 20 form the ponytail 14.

FIGS. 4A, 4B, 4C and 4D show another example embodiment of the barrette in the system, a clasp barrette 60. The clasp barrette 60 has a pair of arms 62 hingedly attached by a hinge 64. When then type of barrette 60 is closed, the arms are parallel and held together by a clasp 66. The clasp barrette 60 is well known to those of ordinary skill in the art.

The clasp barrette 60 of the present disclosure has an interior surface 68 that is covered by hook and loop fastener fabric 30. As shown in FIG. 4C, the hairpiece attaches to the interior surface 68 of the arms 62, the cover 24 of the hairpiece 20 creating a new interior for the barrette 60 and substantially covering the interior surfaces 68 of the arms 62 and hinge 64 of the barrette. The cover 24 protects the natural hair from snagging and damage from friction when the barrette is disposed on the natural hair as described hereinbelow.

Figure 4A:
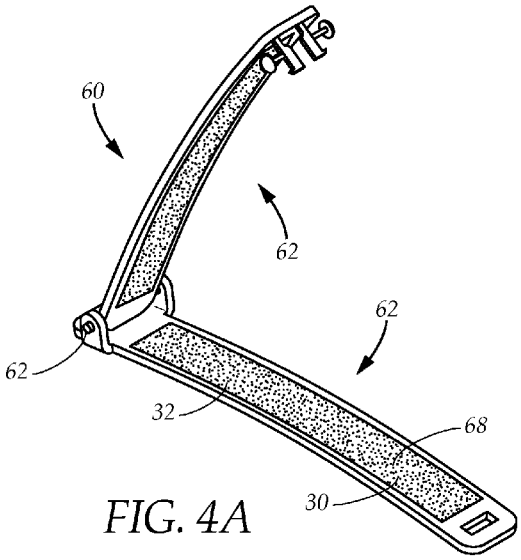
FIG. 4A is a perspective view of an interior of a further example embodiment of the hair extension system with a clasp barrette.
Figure 4B:
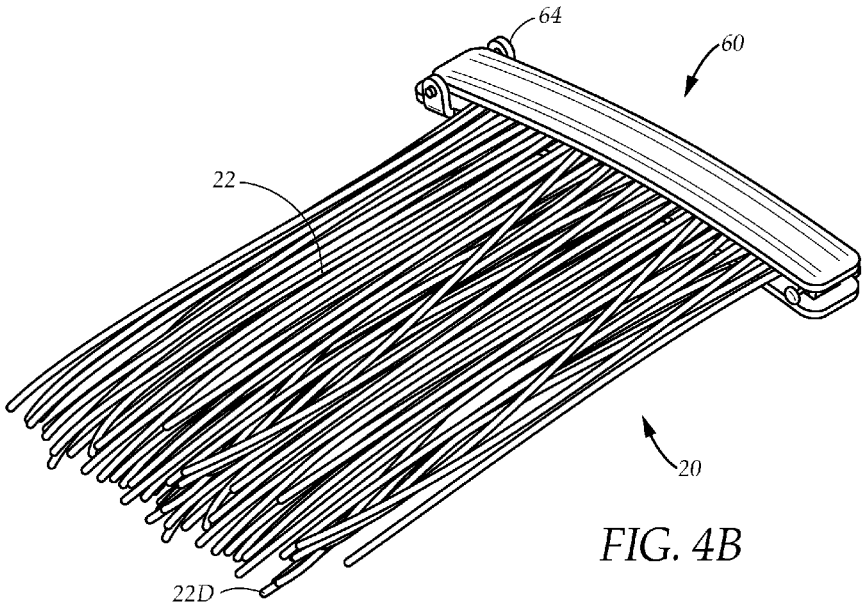
FIG. 4B is a perspective view of an exterior of the further example embodiment of the hair extension system with a clasp barrette and the hair extension.
Figure 4C:
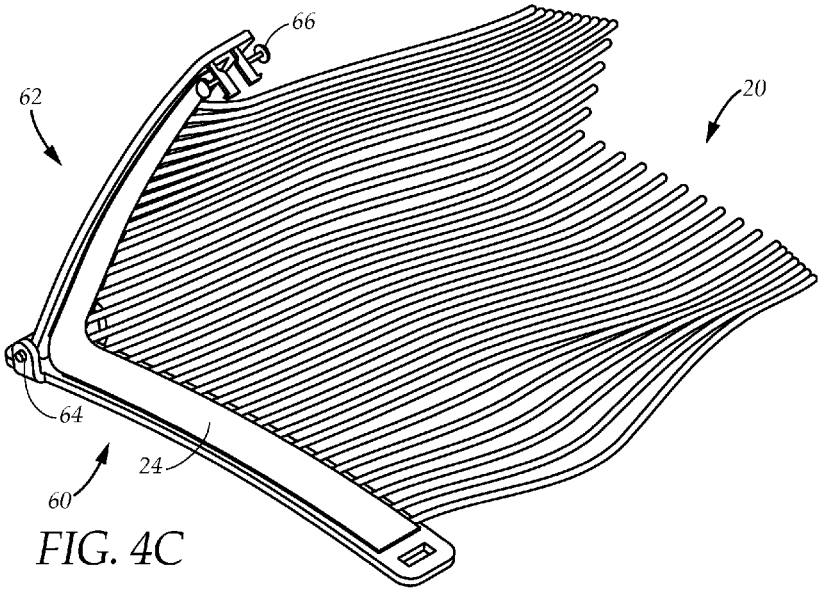
FIG. 4C, similar to FIG. 4A, is a perspective view of the interior of the further example embodiment of the hair extension system with a clasp barrette and the hair extension.
Figure 4D:
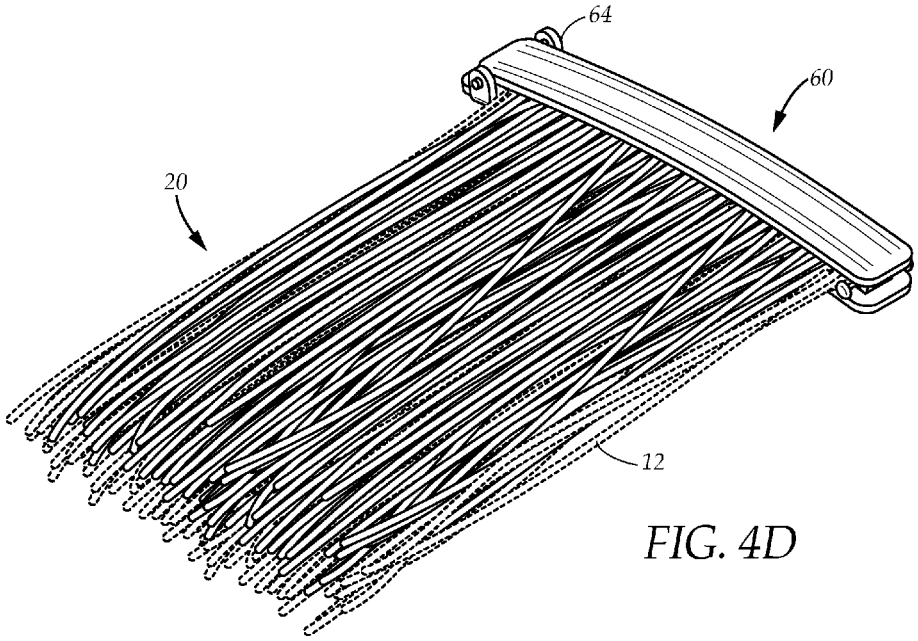
FIG. 4D, similar to FIG. 4B, is a perspective view of an exterior of the further example embodiment of the hair extension system with a clasp barrette and the hair extension integrated with natural hair, shown in outline.

The clasp barrette 60 with the hairpiece 20 attached as shown in FIG. 4C is then place around the natural hair 12 and closed as shown in FIG. 4D. The hairpiece 20 surrounds the natural hair 12 adding volume and in particular, hair length to the hair of the user. By surrounding the natural hair 12, the hairpiece 20 integrates with the natural hair, giving a more natural appearance.

In another example embodiment, the clasp barrette 60 has the hook and loop fastener fabric 30 on one arm 62 and the hairpiece 20 attaches to the one arm as shown in FIG. 4B. The distal ends of the weft 22 are opposite the clasp barrette 60.

Figure 5A:
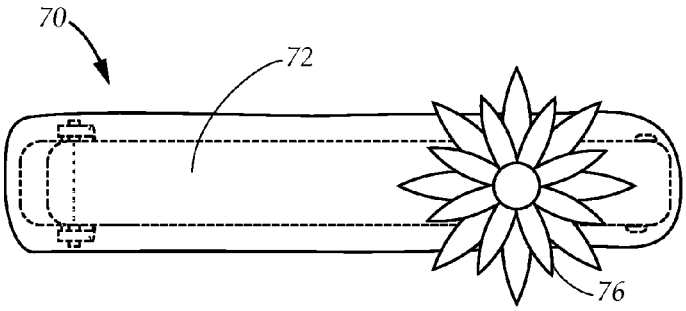
FIG. 5A is a perspective view of an exterior of yet another example embodiment of the hair extension system with a clasp barrette retrofitted by a sheath.
Figure 5B:
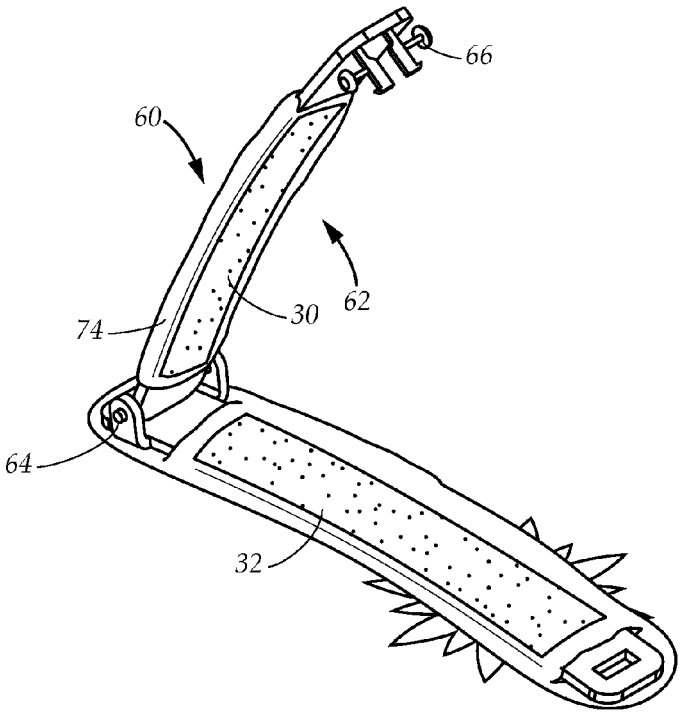
FIG. 5B is a perspective view of an interior of yet another example embodiment of the hair extension system with the retrofitted clasp barrette.

In FIGS. 5A and 5B, show a further example of an example embodiment of the hair extension integration system. A simple clasp barrette 60 can be temporally modified to accommodate the hairpieces of the system. As described hereinabove, the clasp barrette has two arms 62, the hinge 64 and the clasp 66. A sheath 70 having hook and loop fastener fabric 30 can be placed over the arms 62 of the barrette 60, the hook and loop fastener fabric 30 on the interior of the clasp barrette. In one example embodiment, the hook and loop fastener fabric 30 is loop fabric 32. The sheath 70 may be a unitary piece or have a pair of sleeves 74.

The sheath exterior side 72 can have at least one decorative element 76 to transform the appearance of the clasp barrette 60.

When the sheath 70 is placed on the clasp barrette, it functions as the clasp barrette with the hook and loop fastener fabric permanently attached to the arms as explained hereinabove and illustrated in FIGS. 4A-4D. The clasp barrette 60 with the sheath 70 has the hairpiece attached is then place around the natural hair and closed as shown in FIG. 4D.

Further, the sheath 70 is usable with clasp barrette 60 with the hook and loop fastener fabric permanently attached to the arms shown FIGS. 4A-4D in order to add the additional decorative element 76 to transform the appearance of the barrette 60.

FIGS. 1, 3A, 3B, 4A, 4B, 4C, 4D, 5A and 5B together illustrate a hair extension integration kit. The kit comprises the plurality of hairpieces 20 usable with the other components of the kit. In one example embodiment, the hook and loop fastener fabric 30 on the hairpieces 20 is hook fabric 34. The kit further comprises the headband 30 for integrating the hairpieces 20 with the natural hair 12. In one example embodiment, the hook and loop fastener fabric 30 on the headband 30 is loop fabric 32.

The kit can further comprise at least one barrette.

In one example embodiment, the barrette is the pin and cuff barrette 50 having an interior surface 56 covered by hook and loop material 30 configured for coupling to at least one hairpiece 20. In one example embodiment, the hook and loop fastener fabric 30 on the interior surface 56 is loop fabric 32.

In a further example embodiment, the barrette is at least one clasp barrette 60, having a pair of hingedly connected arms 62, each arms having an interior surface 68 covered with a hook and loop fabric 30. In one example embodiment, the hook and loop fastener fabric 30 on the interior surface 68 is loop fabric 32.

In yet a further example embodiment, the kit further comprises a sheath 70 with a pair of sleeves 74 for covering the arms 62 of at least one clasp barrette 60, providing hook and loop fastener 30 material for attaching the hair pieces 20.

The headband of the kit is the linear headband 30 and the kit further comprises the extender segment 46.

It is understood that when an element is referred hereinabove as being "on" another element, it can be directly on the other element or intervening elements may be present therebetween. In contrast, when an element is referred to as being "directly on" another element, there are no intervening elements present.

Moreover, any components or materials can be formed from a same, structurally continuous piece or separately fabricated and connected.

It is further understood that, although ordinal terms, such as, "first," "second," "third," are used herein to describe various elements, components, regions, layers and/or sections, these elements, components, regions, layers and/or sections should not be limited by these terms. These terms are only used to distinguish one element, component, region, layer or section from another element, component, region, layer or section. Thus, "a first element," "component," "region," "layer" or "section" discussed below could be termed a second element, component, region, layer or section without departing from the teachings herein.

Spatially relative terms, such as "beneath," "below," "lower," "above," "upper" and the like, are used herein for ease of description to describe one element or feature's relationship to another element(s) or feature(s) as illustrated in the figures. It is understood that the spatially relative terms are intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device can be otherwise oriented (rotated 90 degrees or at other orientations) and the spatially relative descriptors used herein interpreted accordingly.

Example embodiments are described herein with reference to cross section illustrations that are schematic illustrations of idealized embodiments. As such, variations from the shapes of the illustrations as a result, for example, of manufacturing techniques and/or tolerances, are to be expected. Thus, example embodiments described herein should not be construed as limited to the particular shapes of regions as illustrated herein, but are to include deviations in shapes that result, for example, from manufacturing. For example, a region illustrated or described as flat may, typically, have rough and/or nonlinear features. Moreover, sharp angles that are illustrated may be rounded. Thus, the regions illustrated in the figures are schematic in nature and their shapes are not intended to illustrate the precise shape of a region and are not intended to limit the scope of the present claims.

In conclusion, herein is presented a hair extension integration system. The disclosure is illustrated by example in the drawing figures, and throughout the written description. It should be understood that numerous variations are possible, while adhering to the inventive concept. Such variations are contemplated as being a part of the present disclosure.

What is claimed is:

1. A hair extension integration kit, for selectively adding volume and length to natural hair, consisting of:

an imperforate headband having a hook and loop fabric on a first side and a smooth surface on a second side and a pair of ends selectively fastened by a fastener;

an extender segment that couples to the fastener at the pair of ends of the headband, the extender segment configured for lengthening the headband;

a plurality of hairpieces, in the form of wefts, each of said wefts having a distal end and a proximal end, the distal ends of the wefts disposed between a hook and loop fabric on a first side and a cover on a second side, the hook and loop fabric of the hairpieces configured for selectively coupling to the hook and loop fabric of the head band, the hook and loop fabric on the hairpieces facing away from a user's skin and natural hair;

a pin and cuff barrette, a cuff of the pin and cuff barrette having an interior surface covered by a hook and loop fabric configured for coupling to at least one of the plurality of hairpieces;

a first and a second clasp barrette each having a pair of hingedly connected arms, each arm of the first barrette having an interior surface covered with a hook and loop fabric; and a pair of sleeves, having an exterior surface covered with hook and loop fabric on a side, the pair of sleeves configured for covering the pair of hingedly connected arms of the second barrette.

2. The hair extension integration kit of claim 1, wherein at least one of the pair of sleeves comprises at least one decorative element.

* * * * *